US005169038A

United States Patent [19]

Di Giovanni

[11] Patent Number: 5,169,038

[45] Date of Patent: Dec. 8, 1992

[54] METERING VALVE USABLE IN THE UPSIDEDOWN POSITION

[75] Inventor: Patrick Di Giovanni, La Londe, France

[73] Assignee: Valois (Societe Anonyme), Le Neubourg, France

[21] Appl. No.: 830,859

[22] Filed: Feb. 4, 1992

[30] Foreign Application Priority Data

Jan. 15, 1992 [FR] France ..... 92 000363

[51] Int. Cl.[5] ..... B65D 83/00

[52] U.S. Cl. ..... 222/402.2; 222/453

[58] Field of Search ..... 222/204, 402.1, 402.16, 222/402.2, 416, 453, 454; 239/345, 350

[56] References Cited

U.S. PATENT DOCUMENTS

| | | | |
|---|---|---|---|
| 2,746,796 | 5/1956 | Germain | 222/453 |
| 2,892,576 | 6/1959 | Ward | 222/402.2 |
| 3,003,662 | 10/1961 | Meshberg | 222/402.2 X |
| 3,236,424 | 2/1966 | Ward | 239/350 |
| 3,250,444 | 5/1966 | Ward | 222/402.2 |
| 3,499,584 | 3/1970 | Warren | 222/402.2 |
| 3,591,059 | 7/1971 | Stearns | 222/453 |
| 4,863,073 | 9/1989 | Burt et al. | 222/402.1 |

FOREIGN PATENT DOCUMENTS

| | | | |
|---|---|---|---|
| 101157 | 2/1984 | European Pat. Off. . | |
| 8713851 | 10/1987 | Fed. Rep. of Germany . | |
| 756646 | 9/1956 | United Kingdom | 222/454 |
| 879461 | 5/1962 | United Kingdom | 239/350 |
| 2198707 | 6/1988 | United Kingdom | 222/402.2 |
| 2206100 | 12/1988 | United Kingdom | 222/402.2 |

*Primary Examiner*—Andres Kashnikow
*Assistant Examiner*—Kenneth Bomberg
*Attorney, Agent, or Firm*—Sughrue, Mion, Zinn, Macpeak and Seas

[57] ABSTRACT

A metering valve having a metering chamber (7) and a valve rod (2) lying in a valve body (1). The valve rod includes an inlet channel (211, 214) which puts the metering chamber (207) into communication with a can (11) of substance under pressure when the valve rod is in a rest position. The inlet channel forms a siphon which prevents the valve from draining when it is the rightway up.

10 Claims, 2 Drawing Sheets

METERING VALVE USABLE IN THE UPSIDEDOWN POSITION

The present invention relates to a metering valve usable in the upsidedown position, and intended more particularly for aerosols.

Metering valves for a propellant-charged fluid and usable in the upsidedown position are known that comprise:

a hollow cylindrical valve body having a metering chamber which extends axially between a valve gasket and a chamber gasket each of which is pierced by a central orifice, the valve body also having an inlet passage outside the metering chamber, said inlet passage being adapted to cause the liquid to enter into the valve body when the valve in the upsidedown position;

a valve rod axially slidable in the valve body and slidable in sealed manner through the respective central orifices of the valve gasket and of the chamber gasket, said valve rod being displaceable between a rest position and an actuated position, said valve rod having an outlet end projecting outside the valve body and including an outlet channel which extends axially from said outlet end to a lateral outlet opening, said lateral outlet opening being isolated from the metering chamber by the valve gasket when the valve rod is in its rest position, and said lateral outlet opening being in the metering chamber when the valve rod is in its actuated position, said valve rod further including an inlet channel which extends between a first opening in communication with the inlet passage of the valve body and a second opening which opens out laterally inside the valve chamber when the valve rod is in its rest position, and which is isolated from the metering chamber by the chamber gasket when the valve rod is in its actuated position; and resilient means urging the valve rod towards its rest position.

Those metering valves are generally mounted on the neck of a can or tank which contains a liquid to be sprayed together with a gaseous and/or liquefied propellant. Optionally, the fluid to be sprayed may not be in the form of a liquid, but in the form of a powder in suspension in the liquefied propellant gas. When the valve is not in use, the can is generally stood on its base and the valve is in its non-upsidedown position, i.e. the outlet end of the valve rod points vertically upwards. In this position, the valve body is no longer immersed in the liquid in the can, but on the contrary is surrounded by the compressed gas that overlies the liquid. Consequently, the gas tends to migrate into the metering chamber via the inlet channel of the valve rod, and the liquid contained in the metering chamber tends to flow into the can. The metering chamber thus drains, becoming unprimed after a certain length of time, or at least losing a fraction of the liquid that it contained initially.

One remedy that has been found for this problem is to reduce the diameter of the inlet channel so that capillarity slows down draining. However, the metering chamber nevertheless ends up by becoming unprimed after several hours.

Another solution for preventing the valves becoming unprimed is disclosed in Document FR 2 615 124, which solution is applicable to a different valve in which the valve rod does not include an inlet channel, and in which the chamber gasket is separated from the valve rod in the rest position while being in sealing contact with the valve rod in the actuated position. In that document provision is made to surround the valve body with a retaining cup engaged on the valve body. The drawback of that valve is that when the tank is being filled with liquefied or gaseous propellant, with filling generally taking place through the valve, the propellant must pass through the retaining cup and runs the risk of disengaging it from the valve body because of the high propellant filling pressure.

A particular object of the present invention is to solve the above-mentioned technical problem of maintaining liquid in the metering chamber when the valve is in the non-upsidedown position.

The present invention thus provides a metering valve for a fluid substance charged with a propellant, the valve being usable in the upsidedown position and comprising:

a hollow cylindrical valve body having a metering chamber which extends axially between a valve gasket and a chamber gasket each of which is pierced by a central orifice, the valve body also having an inlet passage outside the metering chamber, said inlet passage being adapted to cause the liquid to enter into the valve body when the valve is in the upsidedown position;

a valve rod axially slidable in the valve body and slidable in sealed manner through the respective central orifices of the valve gasket and of the chamber gasket, said valve rod being displaceable between a rest position and an actuated position, said valve rod having an outlet end projecting outside the valve body and including an outlet channel which extends axially from said outlet end to a lateral outlet opening, said lateral outlet opening being isolated from the metering chamber by the valve gasket when the valve rod is in its rest position, and said lateral outlet opening being in the metering chamber when the valve rod is in its actuated position, said valve rod further including an inlet channel which extends between a first opening in communication with the inlet passage of the valve body and a second opening which opens out laterally inside the valve chamber when the valve rod is in its rest position, and which is isolated from the metering chamber by the chamber gasket when the valve rod is in its actuated position; and resilient means urging the valve rod towards its rest position;

the valve being characterized in that the inlet channel of the valve rod forms a siphon which comprises two axial channel lengths each extending between a first end that is closer to the outlet end of the valve rod and a second end that is further from the outlet end of the valve rod, a first inlet channel length communicating via its second end with the first opening of the inlet channel, a second inlet channel length communicating via its second end with the second opening of the inlet channel, and the two inlet channel lengths communicating with each other via their first ends.

In this way, the valve may remain in the non-upsidedown position without the liquid emptying out of the valve chamber. Tests have shown that the valve of the invention can remain in the non-upsidedown position for more than five days without becoming unprimed and without losing a portion of the measured quantity contained in the valve.

In a particularly advantageous other embodiment, the first ends of the two channel lengths of the inlet channel are to be found axially substantially in the vicinity of the valve gasket when the valve rod is in its rest position. In a particular example of this embodiment, said end of said fixing length is at a certain distance from the transverse wall of said housing so as to define a space between said end and said transverse wall, and both lengths of the inlet channel open out into said space.

In a particular embodiment, the two parts constituting the valve rod co-operate to define a second length of the inlet channel. In a particular example of this embodiment, the fixing length of the second part includes at least one axial groove which co-operates with the housing of the first part to define the second length of the inlet channel. In which case, if the said second part includes a shoulder against which said other end of the first part abuts, said other end may include a radial groove which co-operates with said shoulder to define the second opening of the inlet channel.

In another particular example, the housing of the first part includes at least one axial groove which co-operates with the fixing length of the second part to define the second length of the inlet channel. In which case, if said second part includes a shoulder against which said other end of the first part comes into abutment, then said shoulder may include a radial groove which co-operates with said other end to define the second opening of the inlet channel.

More generally, in all cases where the valve rod is made of two parts, the two parts forming the valve rod may co-operate to define the second opening of the inlet channel.

Other characteristics and advantages of the invention appear in the following description of two embodiments of the invention given by way of non-limiting example and described with reference to the accompanying drawings.

Figure 1:
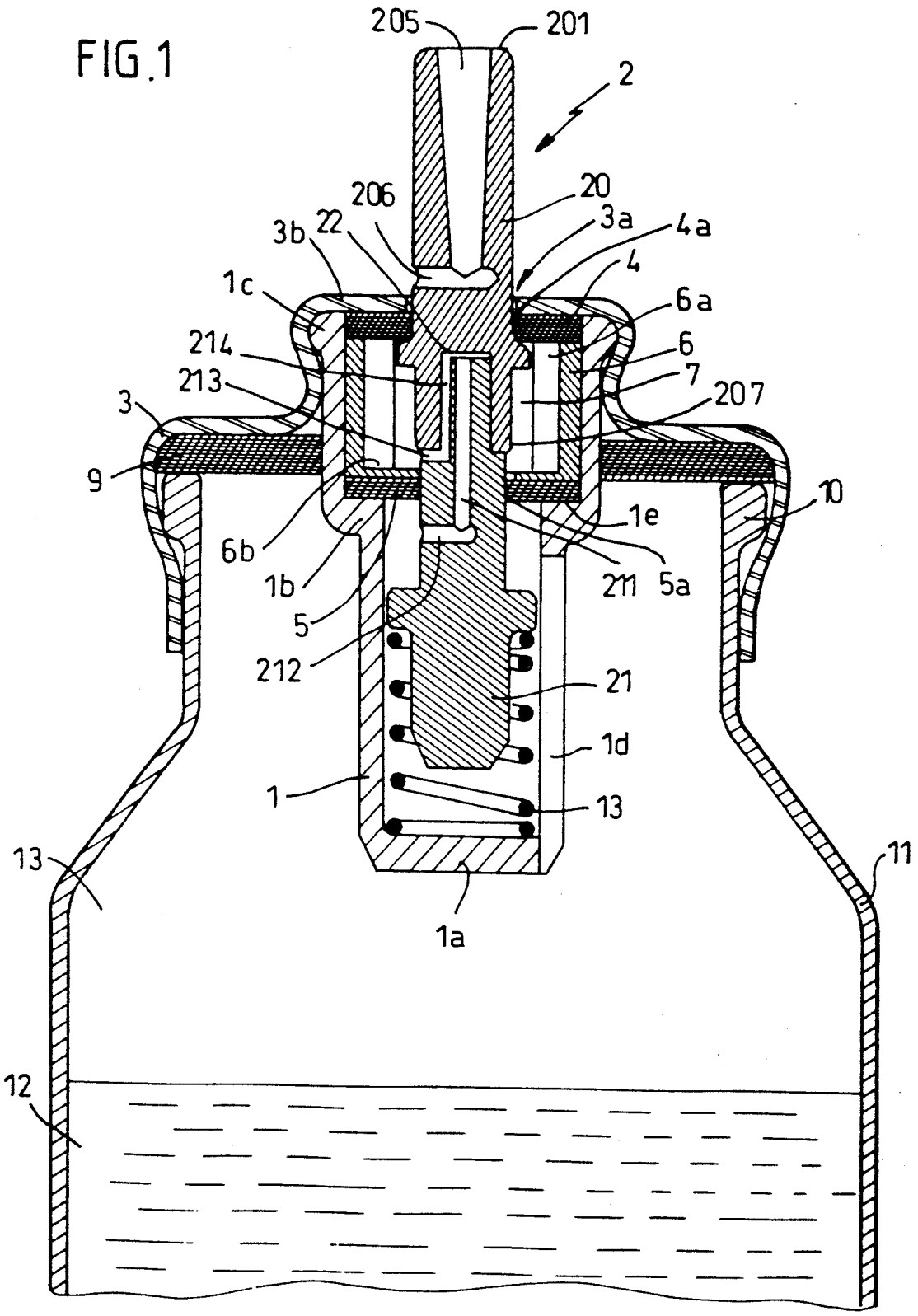
FIG. 1 is a longitudinal section view through a metering valve constituting an embodiment of the invention and mounted on a storage can.

In the drawings, the same references designate items that are similar or identical.

In the following description, the valve is generally described in its non-upsidedown position, as shown in FIG. 1. Terms such as "higher", "lower", "up", "down", etc. are used with reference to this non-upsidedown position, but are used only to facilitate understanding the description without being limiting.

With reference to FIG. 1, the valve of the invention includes in conventional manner a cylindrical valve body 1 which extends axially between a bottom 1*a* and an open end 1*c*. The valve body 1 also includes an enlargement 1*b* which forms an inside shoulder 1*e* that faces the open end 1*c*. Finally, one or more axial slots 1*d* are cut through the valve body 1 between the enlargement 1*b* and the bottom 1*a*. The valve body may be conventionally molded in thermoplastic material.

The valve body 1 is mounted on the neck 10 of a can or tank 11, generally by means of a metal capsule 3 which is crimped onto the neck 10. The metal capsule 3 includes a radial central annular wall 3*b* which overlies the open end 1*c* of the valve body, and said annular wall 3*b* delimits an orifice 3*a* centered on the open end 1*c* of the valve body. An annular neck gasket 9, generally made of elastomer, may be interposed between the neck 10 and the capsule 3. The tank or can 11 contains a liquid 12 that is to be sprayed together with a propellant gas that occupies the space 13 left empty by the liquid. The propellant gas is also generally mixed with the liquid by being dissolved therein or by being liquefied.

Figure 6:
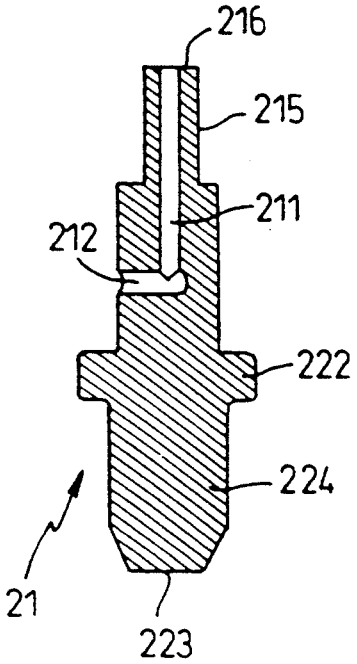
FIGS. 6 and 7 are views respectively similar to FIGS. 2 and 4, but showing a variant embodiment.

A ring 6 which may also be made by molding a thermoplastic material is engaged inside the valve body 1 between its open end 1*c* and the shoulder 1*e* of said valve body. As shown in FIG. 6, the ring 6 may optionally include radially inwardly directed fins 6*a* which extend axially up the height of said ring. In addition, the ring 6 may include an inwardly directed flange 6*b* which extends radially inwards and is clearly visible in FIG. 1.

The valve also includes an annular valve gasket 4 which is generally made of elastomer and which is interposed between the ring and the annular wall 3*b* of the metal capsule 3. The valve gasket 4 extends radially inwardly from the wall of the valve body 1 to a central orifice 4*a*.

An annular chamber gasket 5, generally made of elastomer, is also interposed between the flange 6*b* and the shoulder 1*e* of the valve body. The chamber gasket 5 extends radially inwards from the wall of the valve body 1 to a central orifice 5*a*.

The valve gasket 4 and the chamber gasket 5 axially delimit a metering chamber 7 whose volume may be selected appropriately by changing the thickness of the ring 6 and/or of the fins 6*a*.

In conventional manner, the valve also includes a valve or push rod 2 which is slidably mounted inside the valve body 1. The valve rod slides in sealed manner inside the valve gasket 4 and the chamber gasket 5, and it extends to an outlet end 201 situated outside the valve body, which end generally receives an actuating push-button. The fins 6*a* of the ring 6 may participate in guiding the valve rod 2. A metal coil spring 13 urges the valve rod 2 outwardly from the valve body. The valve rod 2 includes an outwardly directed collar 203 which is clearly visible in FIG. 4 and which is pressed against the valve gasket 4 by the spring 13 when the push rod is in a rest position as shown in FIG. 1. The push rod 2 also includes an inlet channel 211, 214 having two lateral openings 212, 213. While the push rod remains in its rest position, the first opening 212 lies outside the metering chamber 7 and communicates with the tank 11 via the slot 1*d* in the valve body, while the second opening 213 lies inside the metering chamber 7. Thus, the metering chamber 7 is in communication with the tank 11 while the valve rod is in its rest position. The valve rod also includes an axial outlet channel 205 which extends from its outlet end 201 to a lateral opening 206 which is situated outside the metering chamber when the valve rod is in its rest position.

In addition, the valve rod 2 includes an enlarged portion 207 situated between the second opening of the inlet channel and the collar 203.

When it is desired to actuate the valve, it is placed in the upsidedown position, i.e. with the outlet end 201 of the valve rod pointing downwards. When the valve is actuated by pushing the valve rod 2 into the valve body 1 against the urging of the spring 13, the enlarged portion 207 of the valve rod comes to press in sealed contact against the chamber gasket 5*d*, thereby isolating the metering chamber from the inlet channel. As the valve rod continues to be pushed inwards, the lateral opening 206 of the outlet channel penetrates into the metering chamber 7 by sliding through the central orifice 4*a* of the valve gasket 4, where upon the metering chamber 7 which is filled with substance charged with propellant gas empties through the lateral opening 206 and outlet channel 205 under the effect of said propellant gas. When the lateral opening 206 comes inside the metering chamber, the valve rod is in an "actuated" position. In this position, the central portion of the chamber gasket 5 is deformed axially towards the bottom 1*a* of the valve body by thrust from the enlarged portion 207 of the valve rod.

When the valve rod is released, it returns to its rest position while the valve is still in the upsidedown position. Thus, the liquid 12 in the tank 11 is adjacent to the neck 10 of the tank, thereby enabling it to fill the metering chamber 7 via the inlet channel. The advantageous role played by the flange 6*b* while the valve rod 2 is returning to its rest position may be observed. The flange 6*b* extends radially inwards to the vicinity of the valve rod 2, thereby preventing the central portion of the chamber gasket 5 from being entrained by friction against said valve rod 2 towards the metering chamber 7. This prevents inaccuracy on the volume of the metering chamber 7 and/or possible blockage of the second opening 213 of the inlet channel in the rest position.

When no further use is being made of the valve, the device is generally stored by standing the can 11 on its base. The valve is thus in its non-upsidedown position, with the outlet end of the valve rod pointing upwards. In this position, the valve body 1 is no longer surrounded by the liquid contained in the tank 11, but it is surrounded by the gas 13 situated above the liquid.

According to the invention, the inlet channel 211, 214 forms a siphon which includes two axial channel lengths, a first channel length 211 extending axially from a first end closest to the outlet end 201 to a second end in communication with the first opening 212 of the inlet channel, and a second length 214 which extends axially from a first end closest to the outlet end 201 to a second end which is in communication with the second opening 213 of the inlet channel, the two lengths 211 and 214 being connected to each other via their first ends.

Thus, when the valve is not in the upsidedown position, gas may possibly penetrate into the first length 211 of the inlet channel by migrating progressively through the first opening 212 and moving up the channel 211, such that the opening 212 and the length 211 may be emptied progressively of the liquid that they contain. However, the gas is trapped at the first end of the length 211 which, in this position, is likewise the top end of the length. Consequently, the gas that has penetrated to the first end of the length 211 can no longer move down inside the length 214 since the density of the gas is less than the density of the liquid. As a result, the length 214 of the inlet channel, the second opening 213 of the inlet channel, and the metering chamber 7 all remain filled with liquid. Advantageously, the first ends of the lengths 211 and 214 are at substantially the same height as the valve gasket 4 when the valve rod is in its rest position, thereby facilitating the retention of liquid inside the pump chamber. Said first ends could possibly even lie above the level of the valve gasket 4 when the valve rod is in its rest position and the valve is in the non-upsidedown position.

In the particular example shown, the valve rod 2 is made in two pieces or parts 20 and 21 suitable for being molded in thermoplastic material and subsequently for being assembled together by being engaged one within the other, and optionally for being bonded together by ultrasonic welding.

Figure 4:
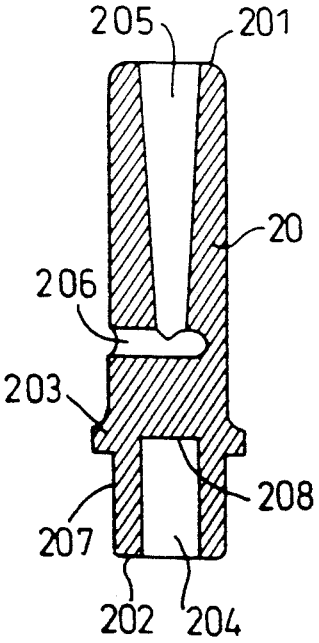
FIG. 4 is a longitudinal section view through the other part constituting the valve rod of the FIG. 1 valve.
Figure 5:
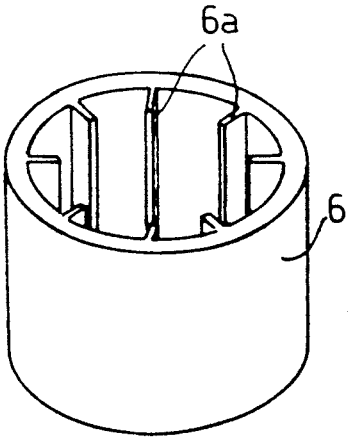
FIG. 5 is a perspective view of a ring that delimits a portion of the metering chamber of the FIG. 1 valve.

As shown in FIG. 4, the valve rod 2 includes a first part 20 which is generally in the form of a circular cylinder extending axially between the outlet end 201 of the push rod and an opposite end 202. Said first part 20 includes the outlet channel 205 and its lateral opening 206, together with the collar 203 and said enlarged portion 207 of the valve rod which is to be found between the end 202 and the collar 203. In addition, the second part 20 includes a cylindrical housing 204 which extends axially from the end 202 of the part 20 over a certain distance towards its outlet end 201 up to a transverse wall 208.

Figure 2:
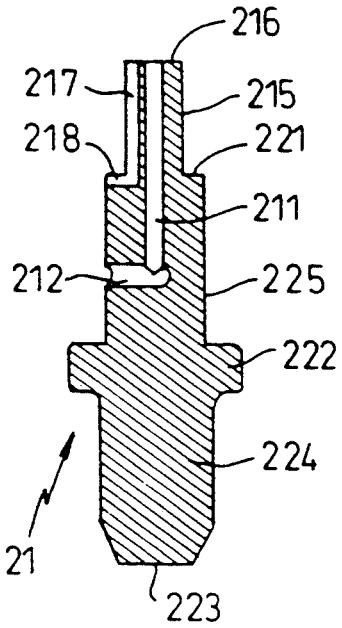
FIG. 2 is a longitudinal section view through one of the two parts constituting the valve rod of the FIG. 1 valve.
Figure 3:
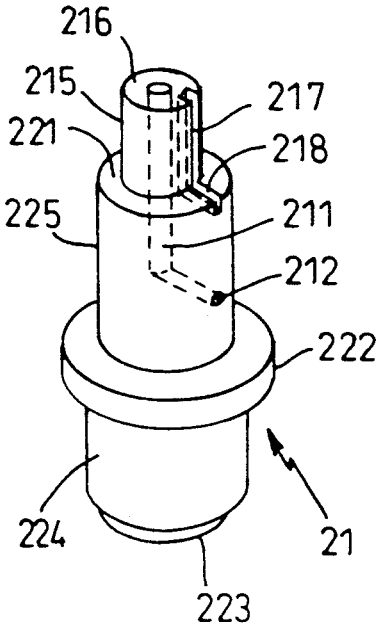
FIG. 3 is a perspective view of the FIG. 2 part.

As shown in FIGS. 2 and 3, the push rod 2 also includes a second part 21 which is likewise generally cylindrical in shape. Said second part 21 extends axially between a first end 223 close to the bottom la of the valve body and a second end 216. Going from said first end 223, said second part 21 comprises firstly a centering finger 224 for the spring 13, then a collar 222 against which the spring 13 bears, then a cylindrical length 225 of diameter smaller than the outside diameter of said portion 207 of the first part 20, and then a cylindrical fixing length 215 which extends axially to said second end 216 of the part 21. The fixing length 215 is adapted to engage in the cylindrical housing 204 of the first part 20, and its inside diameter is less than the outside diameter of the first cylindrical length 225 so that a shoulder 221 facing said second end 216 is formed between the first length 225 and the fixing length 215. In addition, the length of channel 211 extends axially along the center of the part 21 from the second end 216 to the first opening 212 of the inlet channel, which opening extends radially. Finally, the fixing length 215 includes an outside groove 217 which extends axially up the entire height of said length 215, and which connects with a radial groove 218 formed in the shoulder 221, said radial groove 218 extending to the outside of the first length 225 of the part 21.

Thus, when the length 215 is engaged in the housing 204, the end 202 of the first part 20 is in abutment against the shoulder 221 and the lengths of the fixing length 215 and of the housing 204 are such that the end 216 of the length 215 does not touch the transverse wall 208 of the housing 204. In this way, as shown in FIG. 1, a space 22 is left free between the end 216 of the length 215 and the transverse wall 208. The grooves 218 and 217 thus co-operate with the walls of the part 20 to form the second opening 213 and the second channel length 214 of the inlet channel, while the empty space 22 provides communication between the first ends of the channel 214 and of the channel 211. The thickness of the empty space 22, i.e. the axial distance between the end 216 and the transverse wall 208 may advantageously be small, e.g. about 1/10 mm. Capillarity thus limits possible leakage of liquid from channel length 214 to length 211, particularly while the device is being handled or shaken. It would also be possible to make to the first ends of the two channel lengths 211 and 214 to communicate via a groove formed at the end 216 of the second part 21.

Figure 7:
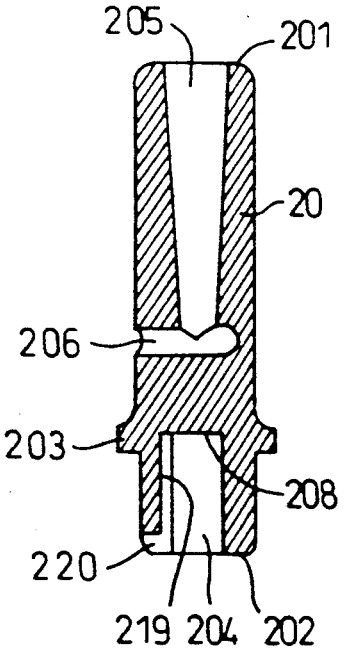

In a variant, as shown in FIGS. 7 and 8, the fixing length 215 of the second part 21 may be solid, while the inside wall of the housing 204 includes an axial groove 219 that communicates with a radial groove 220 at the end of 202 of the part 20, said groove 220 extending radially to the outside of said part 20. The groove 219 thus co-operates with the length 215 to form the second length 214 of the inlet channel, while the groove 220 co-operates with the shoulder 221 of the second part 21 to form the second opening 213 of the inlet channel.

The can 11 is filled with propellant gas or liquefied gas after the valve has been installed on the can. To do this, the valve rod 2 is put into its actuated position and the propellant is injected under pressure via the channel 205. The propellant penetrates into the metering chamber 7 and its pressure deforms the chamber gasket 5 towards the can 11, moving it away from the valve rod 2, thereby allowing the propellant to penetrate into the can 11. The propellant does not follow the siphon of the inlet channel 211, 214 during filling, such that the two parts 20 and 21 of the valve rod do not run the risk of being separated accidentally because of the filling pressure of the propellant.

Other variants will occur to the person skilled in the art.

I claim:

1. A metering valve for a fluid substance charged with a propellant, the valve being usable in the upside-down position and comprising:

a hollow cylindrical valve body (1) having a metering chamber (7) which extends axially between a valve gasket (4) and a chamber gasket (5) each of which is pierced by a central orifice (4*a*, 5*a*), the valve body also having an inlet passage (1*d*) outside the metering chamber, said inlet passage being adapted to cause the liquid to enter into the valve body (1) when the valve is in the upsidedown position;

a valve rod (2) axially slidable in the valve body (1) and slidable in sealed manner through the respective central orifices (4*a*; 5*a*) of the valve gasket (4) and of the chamber gasket (5), said valve rod (2) being displaceable between a rest position and an actuated position, said valve rod having an outlet end (201) projecting outside the valve body and including an outlet channel (205) which extends axially from said outlet end (201) to a lateral outlet opening (206), said lateral outlet opening being isolated from the metering chamber (7) by the valve gasket (4) when the valve rod (2) is in its rest position, and said lateral outlet opening being in the metering chamber (7) when the valve rod (2) is in its actuated position, said valve rod (2) further including an inlet channel (211, 214) which extends between a first opening (212) in communication with the inlet passage (1*d*) of the valve body and a second opening (213) which opens out laterally inside the valve chamber (7) when the valve rod is in its rest position, said second opening being isolated from the metering chamber (7) by the chamber gasket (5) when the valve rod is in its actuated position; and resilient means (13) urging the valve rod towards its rest position;

the valve being characterized in that the inlet channel (211, 214) of the valve rod forms a siphon which comprises a first inlet channel length (211) and a second inlet channel length (214) each extending between a first end that is closer to the outlet end (201) of the valve rod and second ends that are further from the outlet end (201) of the valve rod, said first inlet channel length (211) communicating via its second end with the first opening (212) of the inlet channel, said second inlet channel length (214) communicating via its second end with the second opening (213) of the inlet channel, and the first and second inlet channel lengths communicating with each other via their first ends.

2. A metering valve according to claim 1, further characterized in that the first ends of the two channel lengths (211, 214) of the inlet channel are to be found axially substantially in the vicinity of the valve gasket (4) when the valve rod (2) is in its rest position.

3. A metering valve according to claim 1 or claim 2, further characterized in that the valve rod is made of two parts that are assembled together, a first part (20) including the outlet channel (205) and the lateral outlet opening (206) said first part extending axially between the outlet end and another end (202) provided with a housing (204) which extends axially towards the outlet end up to a transverse wall (208), a second part (21) including a fixing length (215) suitable for engaging in said housing (204), said fixing length (215) having an axial end (216) close to the transverse wall (208) of said housing (204), and the two parts (20, 21) co-operating to define a communication passage (22) between said first ends of the two inlet channel lengths (211, 214).

4. A valve according to claim 3, further characterized in that said end (216) of said fixing length (215) is at a certain distance from the transverse wall (208) of said housing (204) so as to define said communication passage (22) between said end and said transverse wall, and the two inlet channel lengths (211, 214) open out into said communication passage (22).

5. A valve according to claim 3, further characterized in that the two parts (20, 21) forming the valve rod co-operate to define the second length (214) of the inlet channel.

6. A valve according to claim 5, further characterized in that the fixing length (215) of the second part includes at least one axial groove (217) which co-operates with the housing (204) of the first part to define the second inlet channel length (214).

7. A valve according to claim 5, further characterized in that the housing of the first part includes at least one axial groove (219) which co-operates with the fixing length (215) of the second part to define the second inlet channel length (214).

8. A valve according to claim 3, further characterized in that the two parts (20, 21) forming the valve rod (2) co-operate to define the second opening (213) of the inlet channel (211, 214).

9. A valve according to claim 7, further characterized in that said second part includes a shoulder (221) against which said other end (202) of the first part comes into abutment, and said other end (202) includes a radial groove (220) which co-operates with said shoulder to define the second opening (213) of the inlet channel (211, 214).

10. A valve according to claim 6, further characterized in that said second part includes a shoulder (221) against which said other end (202) of the first part comes into abutment, and said shoulder includes a radial groove (218) which co-operates with said other end to define the second opening (213) of the inlet channel (211, 214).

* * * * *